US011177580B2

(12) United States Patent
Wrigley et al.

(10) Patent No.: US 11,177,580 B2
(45) Date of Patent: Nov. 16, 2021

(54) MULTIBAND LINEAR WAVEGUIDE FEED NETWORK

(71) Applicant: LOCKHEED MARTIN CORPORATION, Bethesda, MD (US)

(72) Inventors: Jason Stewart Wrigley, Broomfield, CO (US); Bradley Robert Schaffer, Denver, CO (US)

(73) Assignee: LOCKHEED MARTIN CORPORATION, Bethesda, MD (US)

( * ) Notice: Subject to any disclaimer, the term of this patent is extended or adjusted under 35 U.S.C. 154(b) by 50 days.

(21) Appl. No.: 16/675,115

(22) Filed: Nov. 5, 2019

(65) Prior Publication Data

US 2020/0144731 A1 May 7, 2020

Related U.S. Application Data

(60) Provisional application No. 62/756,510, filed on Nov. 6, 2018.

(51) Int. Cl.

| | |
|---|---|
| ***H01Q 21/00*** | (2006.01) |
| ***H01Q 21/24*** | (2006.01) |
| ***H01Q 5/50*** | (2015.01) |
| *H01Q 3/26* | (2006.01) |

(52) U.S. Cl.

CPC ..... *H01Q 21/0037* (2013.01); *H01Q 5/50* (2015.01); *H01Q 21/24* (2013.01); *H01Q 3/2676* (2013.01)

(58) Field of Classification Search

CPC ..... H01Q 21/0037; H01Q 21/24; H01Q 5/50; H01Q 5/55; H01Q 13/0258; H01P 1/161

See application file for complete search history.

(56) References Cited

U.S. PATENT DOCUMENTS

| | | | | |
|---|---|---|---|---|
| 5,907,309 | A * | 5/1999 | Anderson | H01Q 5/47 343/786 |
| 7,408,427 | B1 * | 8/2008 | Lee-Yow | H01P 1/161 333/126 |
| 9,748,623 | B1 * | 8/2017 | Lee-Yow | H01P 1/161 |
| 10,297,920 | B2 * | 5/2019 | Wrigley | H01P 5/16 |
| 10,763,593 | B1 * | 9/2020 | Wrigley | H01Q 21/245 |
| 2020/0313296 | A1 * | 10/2020 | Mitchelson | H01Q 19/193 |

* cited by examiner

*Primary Examiner* — Seokjin Kim

(74) *Attorney, Agent, or Firm* — Morgan, Lewis & Bockius LLP

(57) ABSTRACT

A linear multiband waveguide feed network device, which includes a first section, a second section, a third section and an inverse-ridge receive (Rx)-reject filter. The second section is coupled to the first section via a first split-plane. The third section is coupled to the second section via a second split-plane. The inverse-ridge Rx-reject filter is implemented as a first half-portion and a second half-portion. The first half-portion and the second half-portion are implemented in the second section and the third section, respectively. The first split-plane and the second split-plane are on a zero-current region of the device.

18 Claims, 10 Drawing Sheets

MULTIBAND LINEAR WAVEGUIDE FEED NETWORK

CROSS-REFERENCE TO RELATED APPLICATION

This application claims the benefit of U.S. Provisional Application No. 62/756,510, entitled "EXTENDED MULTI-BAND LINEAR WAVEGUIDE FEED NETWORK WITH INVERSE RIDGE FILTERS," filed Nov. 6, 2018, the entirety of which is incorporated herein by reference.

STATEMENT REGARDING FEDERALLY SPONSORED RESEARCH OR DEVELOPMENT

Not applicable.

FIELD OF THE INVENTION

The present application generally relates to waveguides and more particularly to a linear multiband waveguide feed network.

BACKGROUND

Typically, antenna waveguide feed networks which cover wide bandwidths such as the extended c-band, are composed of many parts, have a high level of complexity and a very high mass. Lower frequency bands, such as extended c-band, are desirable due to the premium insertion loss offered by the waveguides however the aforementioned high mass and complexity are often intolerable to budgets. Here we present a novel, low-complexity and low-cost alternative that lends itself to low-risk manufacturing with low mass even at c-band.

SUMMARY

According to various aspects of the subject technology, methods and configuration are disclosed for a linear multiband waveguide feed network. The disclosed feed networks include a multipart, multiport, direct-machined, extended C-band waveguide feed with mitigated manufacturing risk via loaded split-block magic tees. Additionally, the linear multiband waveguide feed network is composed of novel inverse ridge harmonic lowpass filters which offer isolation of higher order modes including TE20 in broad receive bands while being able to split on the zero-current region of the waveguide.

In one or more aspects, a linear multiband waveguide feed network device includes a first section, a second section, a third section and an inverse-ridge receive (Rx)-reject filter. The second section is coupled to the first section via a first split-plane. The third section is coupled to the second section via a second split-plane. The inverse-ridge Rx-reject filter is implemented as a first half-portion and a second half-portion. The first half-portion and the second half-portion are implemented in the second section and the third section, respectively. The first split-plane and the second split-plane are on the zero-current region of the device.

In other aspects, a waveguide feed apparatus includes an RX portion and a Tx portion. The Rx portion includes an Rx orthomode transducer (OMT), a Tx reject filter and a main manifold. The Tx portion consists of a front Tx portion and a second Tx portion. The first Tx portion includes a plurality of inverse-ridge Rx-reject filters and a Tx magic tee, and the second Tx portion includes a Tx V-Pol magic tee and a pair of Tx V-Pol waveguide H-bends that are coupled to a Tx V-Pol port. The Tx V-Pol port is implemented in a first section of the apparatus, the Tx reject filter is implemented in a second section of the apparatus, and the inverse-ridge Rx-reject filters and the Tx magic tee are common between the second section and a third section of the apparatus. A first split plane between the first section and the second section and a second split plane between the second section and the third section are on a zero-current region of the apparatus.

In yet other aspects, a satellite communication system includes a satellite antenna and a feed network device, which includes a first section, a second section and a third section. The second section is coupled to the first section via a first split-plane, and a third section is coupled to the second section via a second split-plane. An inverse-ridge Rx-reject filter is implemented as a first half-portion in the second section and a second half-portion in the third section. The first split-plane and the second split-plane are on a zero-current region of the feed network device, and the feed network device is a linear and multiband waveguide.

The foregoing has outlined rather broadly the features of the present disclosure so that the following detailed description can be better understood. Additional features and advantages of the disclosure, which form the subject of the claims, will be described hereinafter.

BRIEF DESCRIPTION OF THE DRAWINGS

For a more complete understanding of the present disclosure and the advantages thereof, reference is now made to the following descriptions to be taken in conjunction with the accompanying drawings describing specific aspects of the disclosure, wherein.

DETAILED DESCRIPTION

The detailed description set forth below is intended as a description of various configurations of the subject technology and is not intended to represent the only configurations in which the subject technology can be practiced. The appended drawings are incorporated herein and constitute a part of the detailed description. The detailed description includes specific details for the purpose of providing a thorough understanding of the subject technology. However, it will be clear and apparent to those skilled in the art that the subject technology is not limited to the specific details set forth herein and can be practiced using one or more implementations. In one or more instances, well-known structures and components are shown in block diagram form in order to avoid obscuring the concepts of the subject technology.

In some aspects of the present technology, methods and configuration are disclosed for a linear multiband waveguide feed network. The disclosed feed network is a multipart, multiport, direct-machined, extended C-band waveguide feed with mitigated risk via loaded split-block power splitters and inverse-ridge harmonic filters. Prior approaches include using traditional harmonic filters that cannot be split on the zero-current region of the waveguide. The topology nearly always uses electroforms or has a significant number of parts (e.g., at least eight parts) as a split block that becomes much more complex with significantly higher risk. The subject technology includes significant advantages over prior approaches including, but not limited to, cost savings, schedule savings and the lowest complexity solution that is readily manufactured.

The linear multiband waveguide feed network of the subject technology consists of three direct-machined sections including advantageously positioned components and inverse-ridge harmonic filters of the subject technology. The subject disclosure includes a waveguide feed that is composed of three sectional parts with all split-planes in the low-risk zero-current regions of the waveguides. The subject technology avoids electroforming and mitigates risk by incorporating power splitters. For example, the broadband split-block power splitters have been developed to mitigate risk in path length mismatch for recombination networks in transmitters (Tx).

The subject technology provides for a broadband linearly polarized waveguide solution that is a three-part assembly covering extended C-band based on the positioning of the components within the split-planes as well as the split-plane selection. It is this positioning and selection that leads to significant mass and complexity reductions as well as manufacturing risk mitigation.

Figure 1:
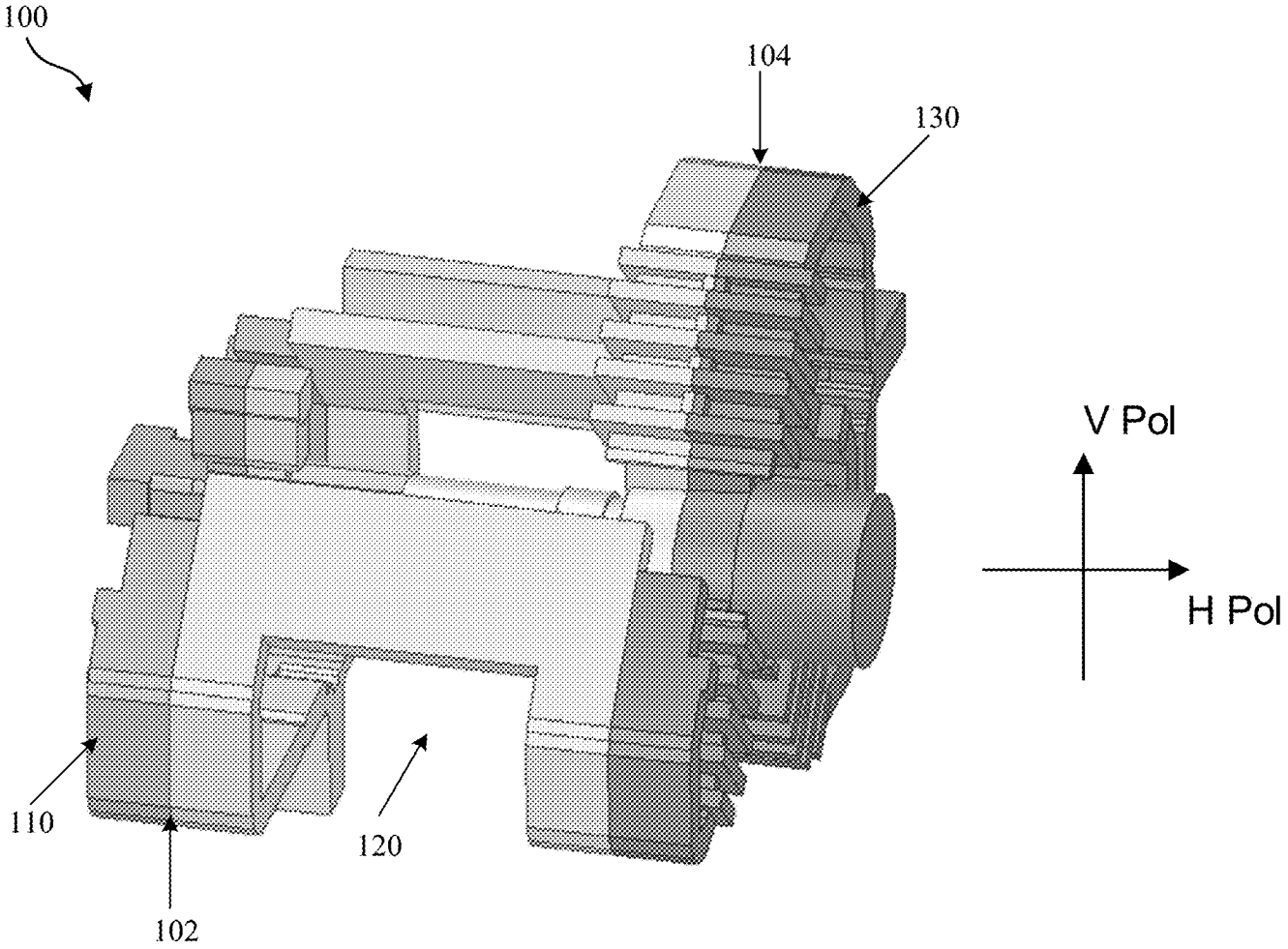
FIG. 1 is a schematic diagram illustrating an example of a linear multiband waveguide feed, according to certain aspects of the disclosure.

FIG. 1 is a schematic diagram illustrating an example of a linear multiband waveguide feed network 100, according to certain aspects of the disclosure. The linear multiband waveguide feed network 100 (hereinafter "waveguide feed 100") is made of three sections: a rear section 110, a middle section 120 and a front section 130, as will be described in more detail below. Split-plane 102 separates the rear section 110 and the middle section 120, which is separated from the front section 130 by the split-plane 104. The split-planes 102 and 104 are in the low-risk zero-current regions of the waveguide feed 100.

Also shown in FIG. 1 are the direction of the vertical polarization (V-Pol) and horizontal polarization (H-Pol). The waveguide feed 100 can function to transmit V-Pol and H-POL in one frequency range. For the purpose of the subject disclosure, the Tx frequency band is defined to be within a range of 3.4 GHz to 4.2 GHz. The waveguide feed 100 can also function to receive (Rx) V-Pol and H-Pol in one frequency range that, for the purpose of the subject disclosure, is defined to be within a range of 5.70 GHz to 6.80 GHz. The waveguide feed 100 is designed such that the Rx and Tx signals are sufficiently isolated from one another. For a ground application, Rx and Tx would be flipped such that Rx is the lower frequency band. For installation on a spacecraft, considered in the present disclosure, the Rx is the higher-frequency band of the two bands.

The waveguide feed 100 is a high-performance, low-mass and low-cost waveguide-feed solution for extended multibands, including C-band (defined as Tx: 3.400 GHz to 4.200 GHz and Rx: 5.725 GHz to 6.725 GHz). The waveguide feed 100 can be readily scaled to any frequency band beyond the C-band, which requires linear operation. For example, the waveguide feed 100 can be scaled for $K_a$ band or other frequency bands as well. Furthermore, the waveguide feed 100 can readily be altered to also handle circularly polarized applications by adding a polarizer to the circular antenna port.

Figure 2:
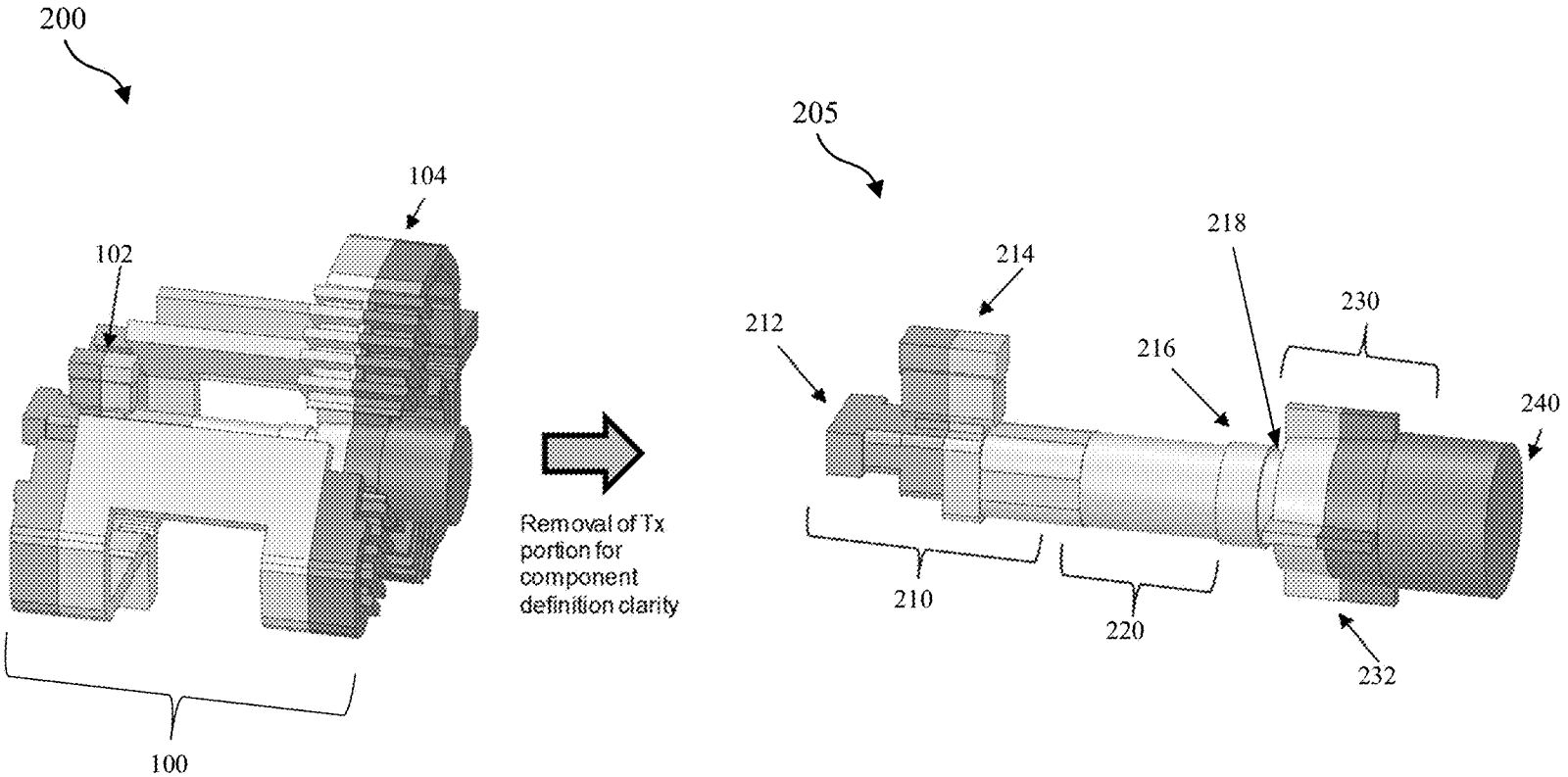
FIG. 2 is a schematic diagram illustrating structural details of the receive (Rx) portion of an exemplary linear multiband waveguide feed, according to certain aspects of the disclosure.

FIG. 2 is a schematic diagram illustrating structural details of Rx portion 205 of an exemplary linear multiband waveguide feed 200, according to certain aspects of the disclosure. The linear multiband waveguide feed 200 is similar to the waveguide feed 100 of FIG. 1 and is shown as a reference. The Rx portion 205 is exposed after removal of the Tx portion from the waveguide feed 200. The Rx portion 205 includes an Rx orthomode transducer (OMT) 210, a Tx reject filter 220, a main manifold 230 and an antenna port 240. The Rx OMT 210 includes an Rx V-Pol port 212 and an Rx H-Pol port 214. The Tx reject filter 220 is coupled to the main manifold 230 via a matching ring 216 and a step to Tx reject filter 218. The main manifold 230 includes four waveguide ports 232 that are symmetrically spaced at 90 degrees.

The Rx OMT 210 separates and combines orthogonal V-Pol and H-Pol Rx signals. The matching ring 216 matches Rx signals into the main manifold 230. The antenna port 240 mates to a radio-frequency (RF) antenna (not shown for simplicity) to propagate and receive Tx and Rx signals, both of which propagate in the transverse-electric (TE)11 dominant mode. The Tx reject filter 220 is a circular waveguide that is selected such that it can reject Tx signals but passes Rx signals, both of which propagate in the TE11 dominant mode. The step to Tx reject filter 218 steps down to the circular waveguide of the Tx reject filter 220, which is in cutoff at Tx frequencies. The Rx V-Pol port 212 and the H-Pol port 214 are rectangular waveguide ports used to receive V-Pol and H-Pol signals, respectively. It is noted that the solid bodies shown in FIG. 2 represent the air cavity of the feed network. The fabrication model, as is shown later below, is a shelled version of this air cavity. The different shades of grey are used to introduce clarity to the split-planes.

Figure 3:
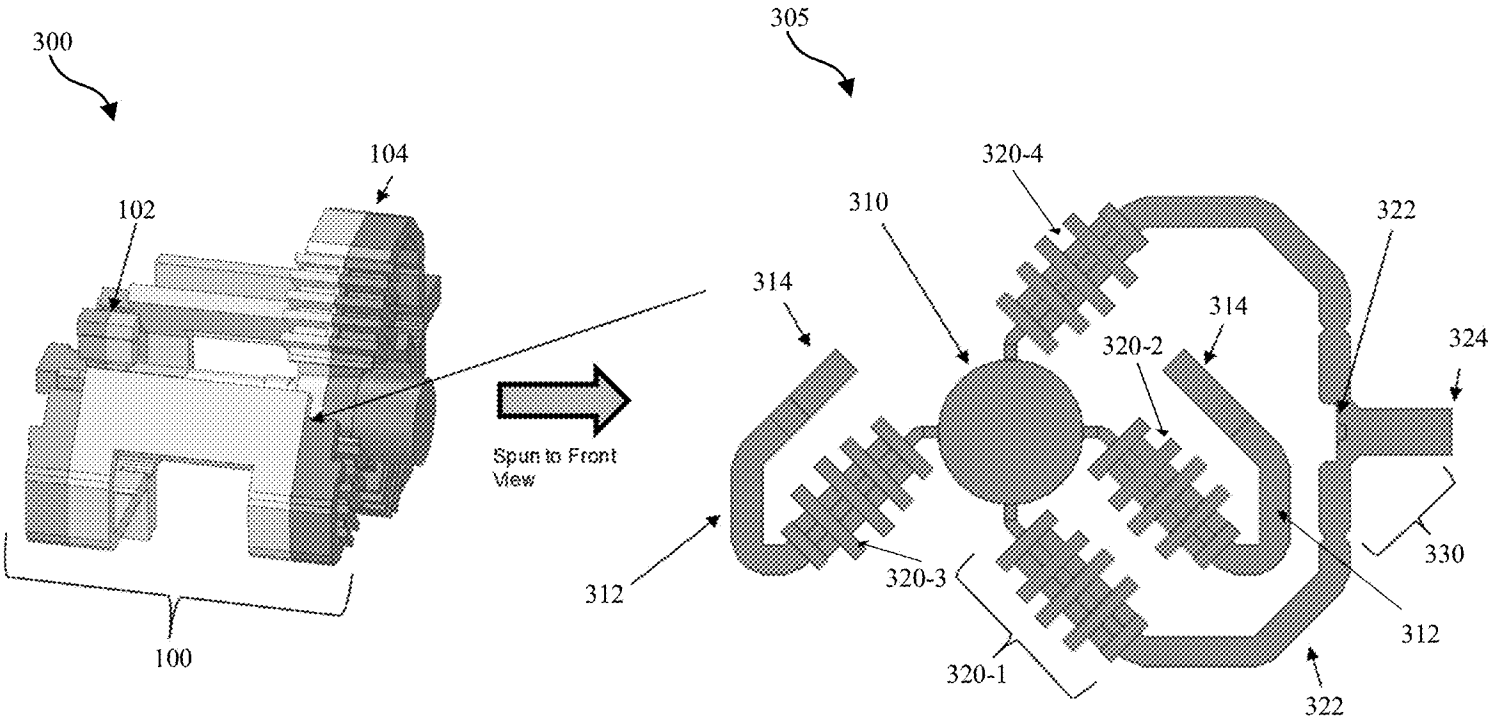
FIG. 3 is a schematic diagram illustrating structural details of a front transmit (Tx) portion of an exemplary linear multiband waveguide feed, according to certain aspects of the disclosure.

FIG. 3 is a schematic diagram illustrating structural details of a front Tx portion 305 of an exemplary linear multiband waveguide feed 300, according to certain aspects of the disclosure. The linear multiband waveguide feed 300 is similar to the waveguide feed 100 of FIG. 1 and is shown as a reference. The Tx portion 305 includes an antenna port 310, four inverse-ridge Rx-reject filters 320 (320-1, 320-2, 320-3 and 320-4), a Tx H-Pol magic tee 330, and a loaded waveguide port 322. The inverse-ridge Rx-reject filters 320 are broad rejection-band harmonic filters that can be split in the zero-current region with no undercuts, and serve the purpose of rejecting Rx signals while passing Tx signals. The magic tee 330, also referred to as a hybrid tee, is an electric-field and magnetic-field 3-dB coupler. These inverse-ridge Rx-reject filters 320 have been advantageously folded at 45 degrees to drive down diametrical fit while still appearing RF symmetric. The inverse-ridge Rx-reject filters 320-2 and 320-3 are coupled via Tx V-Pol recombination arms 312 to Tx V-Pol rectangular-waveguide (RWG) H-plane bends (Hbends) 314. The Tx V-Pol RWG Hbends 314 serves the purpose of symmetrically routing the Tx V-Pol waveguides from the second split-plane 104 to the first split-plane 102. The second split-plane 104, as will be shown later, contains the V-Pol magic tee, which has been elegantly placed in the same split-plane as the Rx OMT 210 of FIG. 2. The antenna port 310 is similar to the antenna port 240 of FIG. 2. The Tx H-Pol magic tee 330 serves the purpose of separating the Tx H-Pol signal on the loaded waveguide port 324 (sum port) while mitigating the risk of path-length mismatch via a loaded difference port. The split signals are fed through the inverse-ridge Rx-reject filters 320-1 and 320-4 and are recombined at the main manifold. A Tx H-Pol path 322 is a driven rectangular waveguide path forming Tx H-Pol signal for the waveguide feed 300. The Tx H-Pol recombination arms 322 serve the purpose of symmetrically routing the waveguides from the H-Pol magic tee 330 to the inverse-ridge Rx-reject filters 320 and the main manifold 230 of FIG. 2. The Tx V-Pol recombination arms 312 fold back into the page to be later mated with a V-Pol magic tee (not shown here for simplicity).

Figure 4:
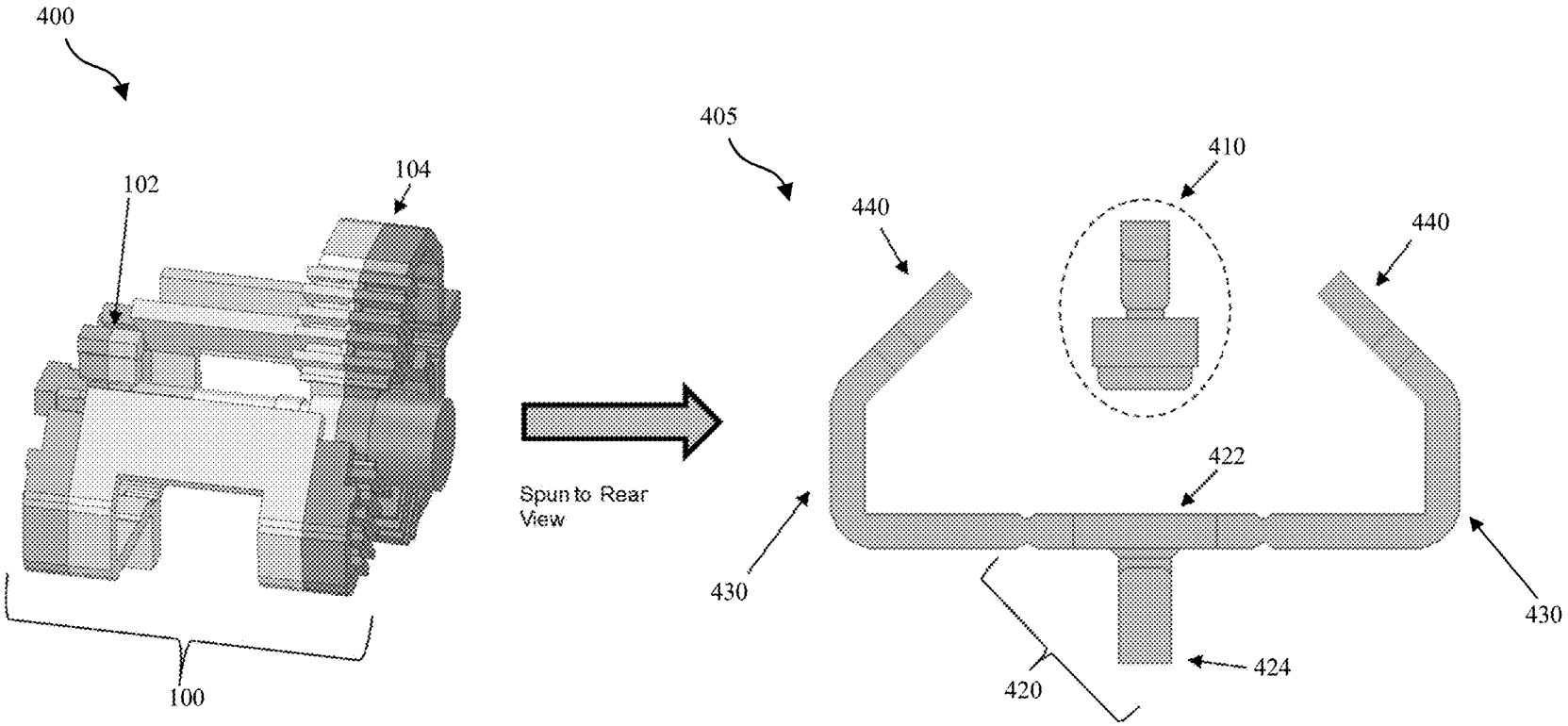
FIG. 4 is a schematic diagram illustrating structural details of a rear Tx portion of an exemplary linear multiband waveguide feed, according to certain aspects of the disclosure.

FIG. 4 is a schematic diagram illustrating structural details of a rear Tx portion 405 of an exemplary linear multiband waveguide feed 400, according to certain aspects of the disclosure. The linear multiband waveguide feed 400 is similar to the waveguide feed 100 of FIG. 1 and is shown as a reference. The rear Tx portion 405 includes an Rx OMT 410 and a Tx V-Pol magic tee 420, which is coupled via Tx V-Pol recombination arms 430 to Tx V-Pol RWG Hbends 440. The Tx V-Pol magic tee 420 includes a Tx V-Pol port 422 and a loaded waveguide port 424. The Tx V-Pol RWG Hbends 440 is rectangular waveguide that serves the purpose of symmetrically routing the Tx V-Pol waveguides from the second split-plane 104 to the first split-plane 102. The first split-plane 102, as will be shown later, contains the V-Pol magic tee (not shown here for simplicity), which is elegantly placed in the same split-plane as the Rx OMT 410 (210 of FIG. 2). The Tx V-Pol magic tee 420 serves the purpose of separating the Tx V-Pol signal on the loaded waveguide port 424 (sum port) while mitigating the risk of path-length mismatch via a loaded difference port. The split signal is fed through the inverse-ridge Rx-reject filters 320 of FIG. 3 and is recombined at the main manifold 230 of FIG. 2.

Figure 5:
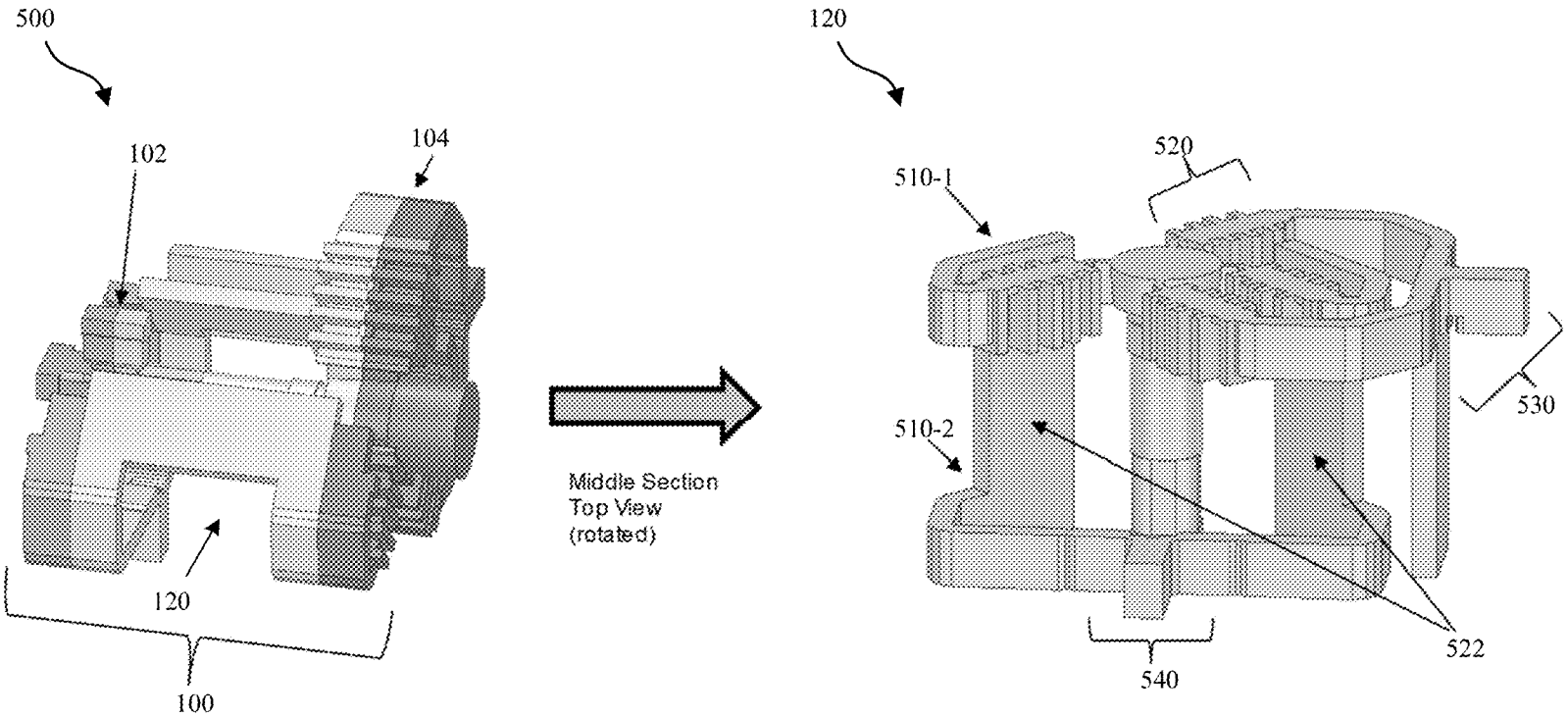
FIG. 5 is a schematic diagram illustrating structural details of a middle section portion of an exemplary linear multiband waveguide feed, according to certain aspects of the disclosure.

FIG. 5 is a schematic diagram illustrating structural details of a middle section 120 of an exemplary linear multiband waveguide feed 500, according to certain aspects of the disclosure. The linear multiband waveguide feed 500 is similar to the waveguide feed 100 of FIG. 1 and is shown as a reference. The middle section 120 includes two Tx V-Pol RWG Hbends 510, four Rx inverse-ridge reject filters 520, a Tx H-Pol magic tee 530 and a Tx V-Pol magic tee 540, and Tx waveguide routings 522. The Tx V-Pol RWG Hbends 510 (510-1 and 510-2) match with and are coupled to the Tx V-Pol RWG Hbends 314 of FIG. 3. The inverse-ridge reject filters 520 match with and are coupled to the inverse-ridge Rx reject filters 320 of FIG. 3. The Tx waveguide routings 522 couple the Tx V-Pol RWG Hbends 510-1 and 510-2.

Figure 6:
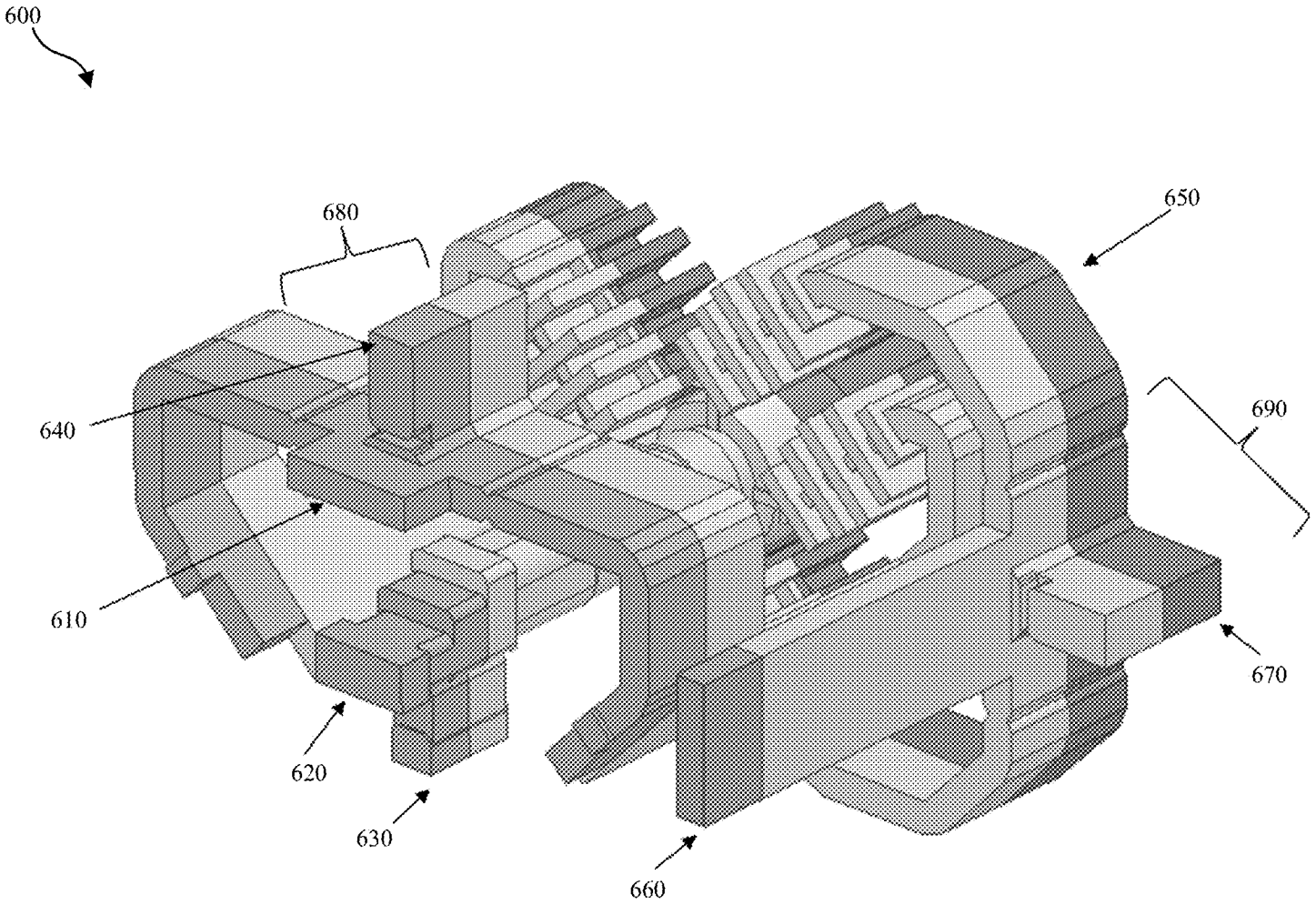
FIG. 6 is a schematic diagram illustrating structural details of an exemplary linear multiband waveguide feed, according to certain aspects of the disclosure.

FIG. 6 is a schematic diagram illustrating structural details of an exemplary linear multiband waveguide feed 600, according to certain aspects of the disclosure. The linear multiband waveguide feed 600 (hereinafter "waveguide feed 600") is similar to the waveguide feed 100 of FIG. 1 and is depicted herein for further clarity and to show the location of various ports of the waveguide feed 600. The ports include a Tx V-Pol port 610, an Rx V-Pol 620, an Rx H-Pol port 630, a first loaded port 640, an antenna port 650, a Tx H-Pol port 660 and a second loaded port 670. Also shown in FIG. 6 are a Tx V-Pol magic tee 680 and a Tx H-Pol magic tee 690, which are the same as the Tx H-Pol magic tee 330 of FIG. 3 and a Tx V-Pol magic tee 420 of FIG. 4, respectively. It is noted that the split-plane passing through the Rx V-Pol magic tee 680 is elegantly shared with the Rx OMT (e.g., 210 of FIG. 2), which facilitates forming a three-part assembly.

Figure 7:
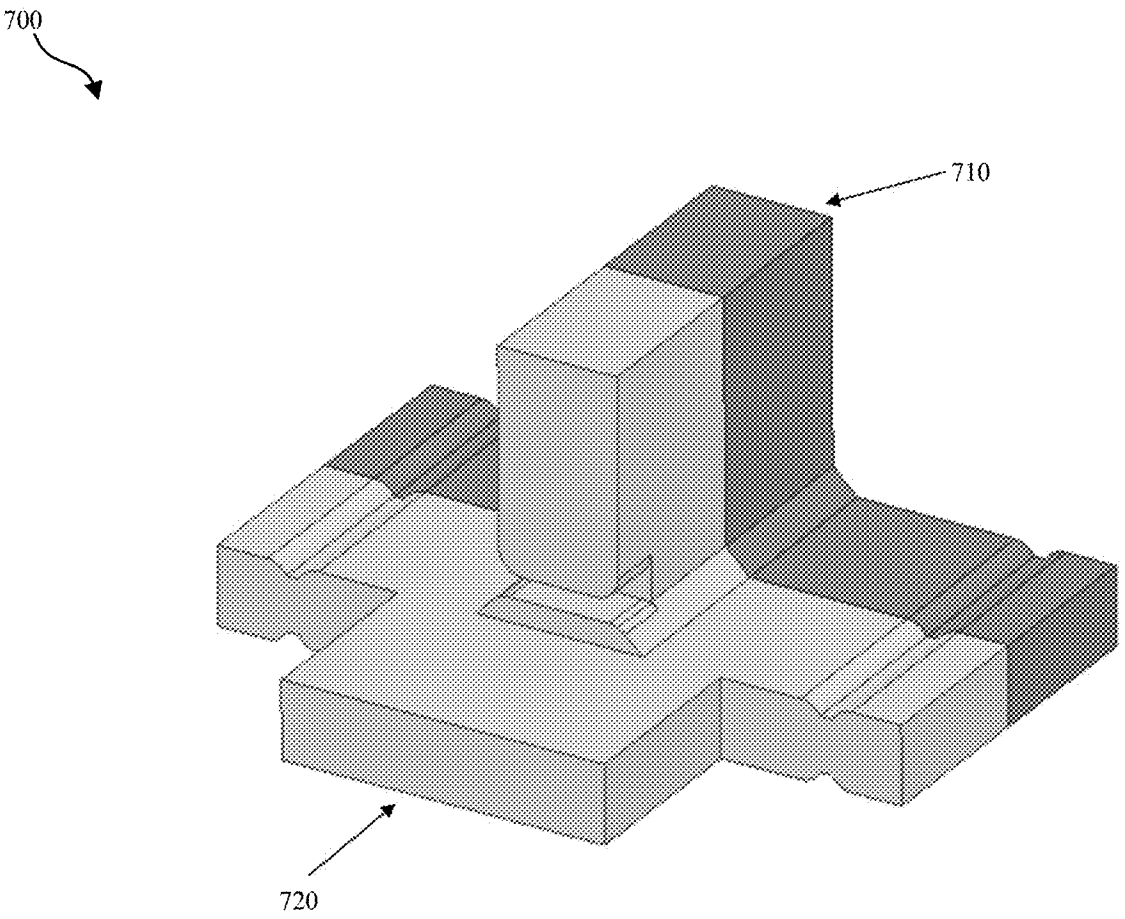
FIG. 7 is a schematic diagram illustrating structural details of a magic tee of an exemplary linear multiband waveguide feed, according to certain aspects of the disclosure.

FIG. 7 is a schematic diagram illustrating structural details of a magic tee 700 of an exemplary linear multiband waveguide feed, according to certain aspects of the disclosure. The magic tee 700 represents the Tx H-Pol magic tee 690 and the Tx V-Pol magic tee 680 of FIG. 6 and includes a difference port 710 and sum port 720. The difference port 710 is always loaded to mitigate manufacturing risk. The sum port 720 can, for example, be used as Tx V-Pol port (e.g., 610 of FIG. 6) or Tx H-Pol port (e.g., 660 of FIG. 6).

Figure 8:
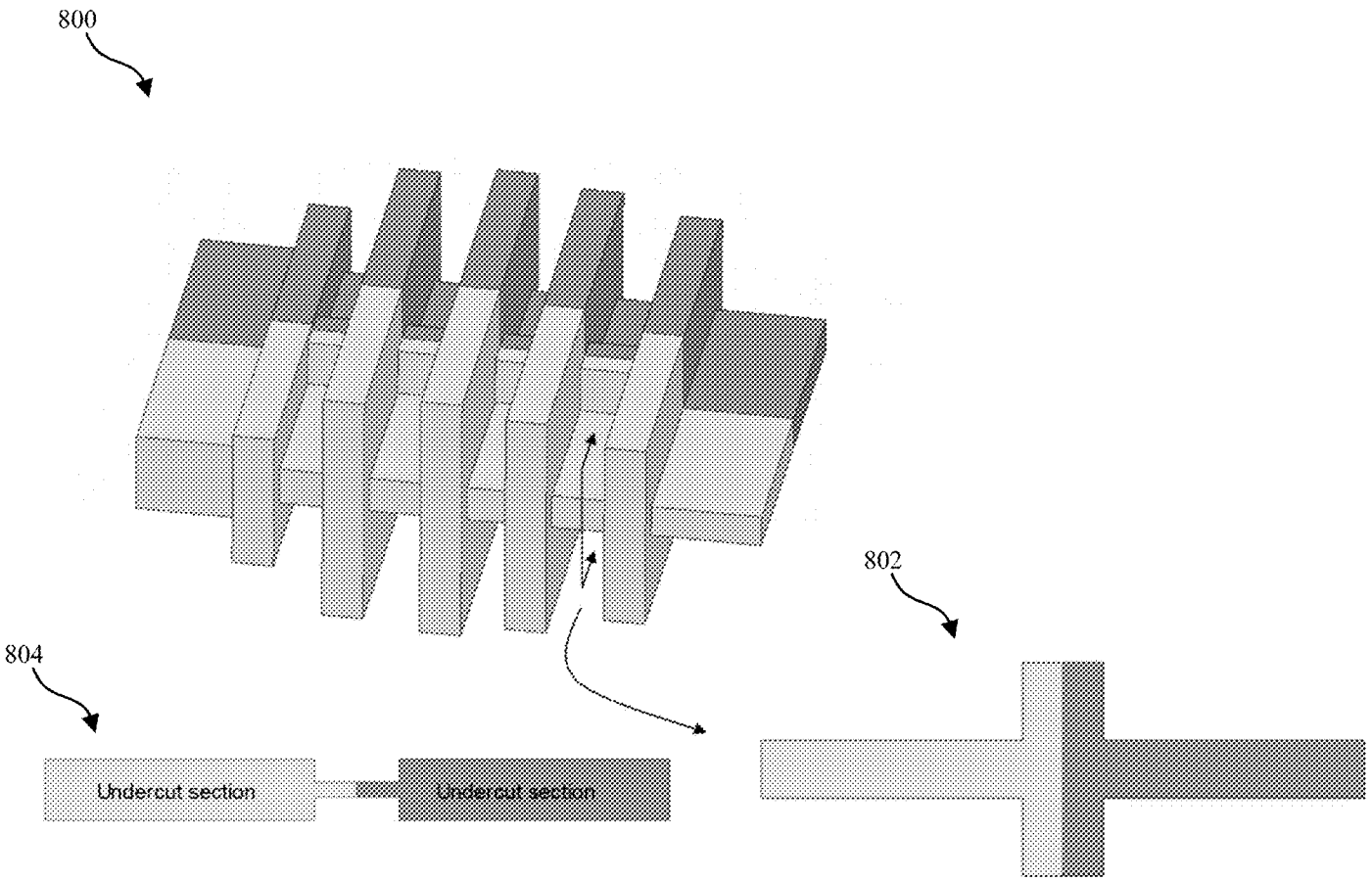
FIG. 8 is a schematic diagram illustrating structural details of an inverse-ridge filter of an exemplary linear multiband waveguide feed, according to certain aspects of the disclosure.

FIG. 8 is a schematic diagram illustrating structural details of an inverse-ridge filter 800 of an exemplary linear multiband waveguide feed, according to certain aspects of the disclosure. The inverse-ridge filter 800 is the same as the inverse-ridge filters 320 of FIG. 3 and introduces a geometry that offers a broadband isolation of higher order modes, namely the TE20 mode, over broad bandwidths (e.g., 5.7 GHz to 6.75 GHz). A cross-section view 802 of the inverse-ridge filter 800 shows that the inverse-ridge filter 800 can be split on the zero-current region of the waveguide without introducing fabrication undercuts. On the contrary, a cross-section view 804 of a traditional ridge filter indicates that the traditional ridge filters cannot be split on the zero-current region of the waveguide without introducing fabrication undercuts. Further, the cross-sectional view 804 indicates that in the traditional ridge there is no tool access for machining due to the undercuts.

Figure 9:
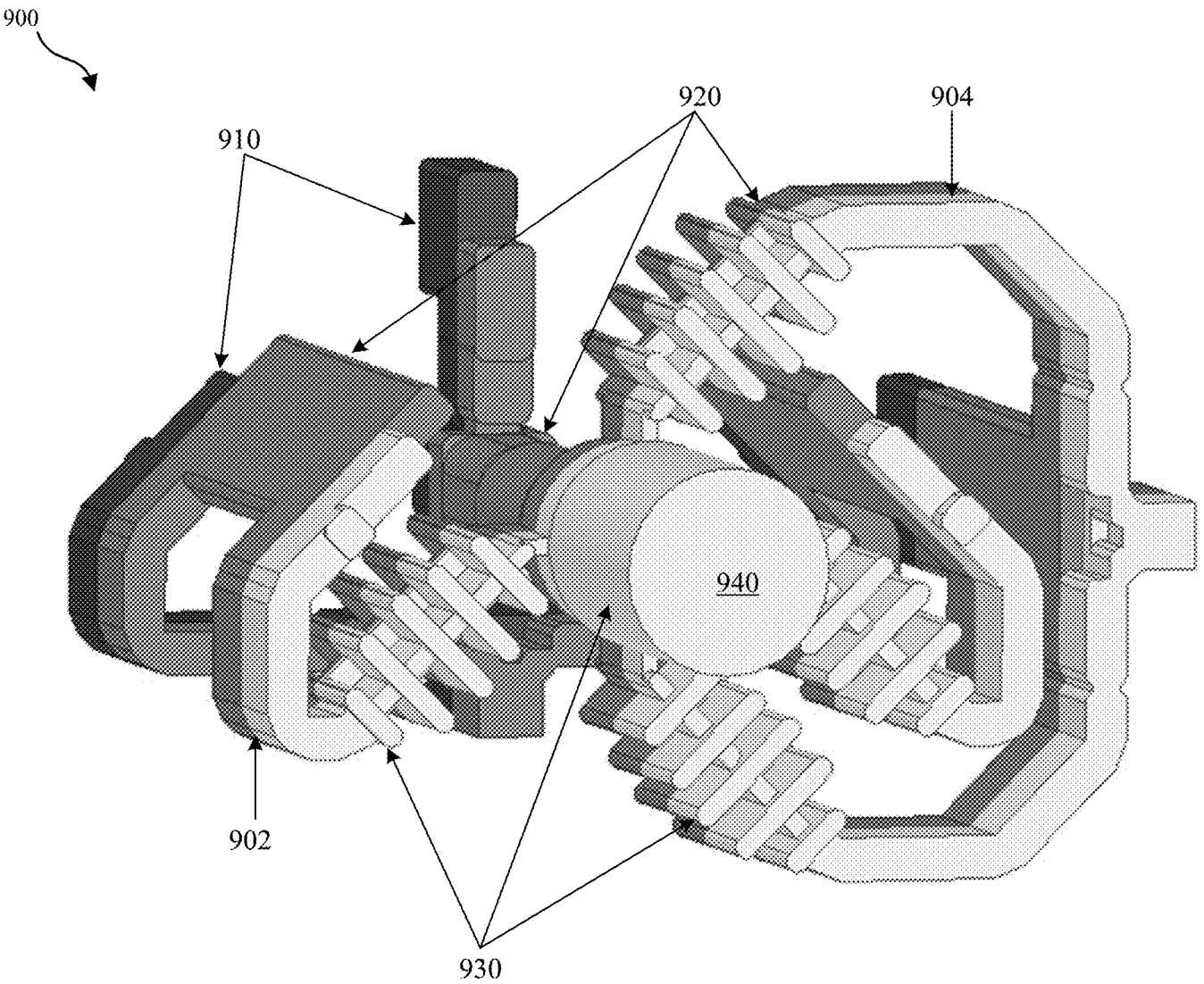
FIG. 9 is a schematic diagram illustrating the front view of an exemplary linear multiband waveguide feed, according to certain aspects of the disclosure.

FIG. 9 is a schematic diagram illustrating a front view of an exemplary linear multiband waveguide feed 900, according to certain aspects of the disclosure. The front view of the exemplary linear multiband waveguide feed 900 depicts three parts, a rear section 910, a middle section 920 and a front section 930. Also shown are the first split-plane 902 and the second split-plane 904. The three parts can be either brazed or traditionally fastened together with hardware such as screws. The two split-planes 902 and 904 through the device are on the zero-current regions of the waveguides. The rear section 910 contains the Rx OMT, Tx V-Pol magic tees and Tx recombination arms, as described above. The middle section 920 contains the step to the circular waveguide, the Tx reject filters, the inverse-ridge filters, the Tx H-Pol magic tee, the Tx V-Pol recombination arms, the Tx H-Pol recombination arms, the Tx Hbends, the Rx OMT and the Tx waveguide routing, as described above. The front section 930 contains the antenna port 940, the main manifold, the inverse-ridge filters, the H-Pol magic tee and the Tx recombination arms, as described above.

Figure 10:
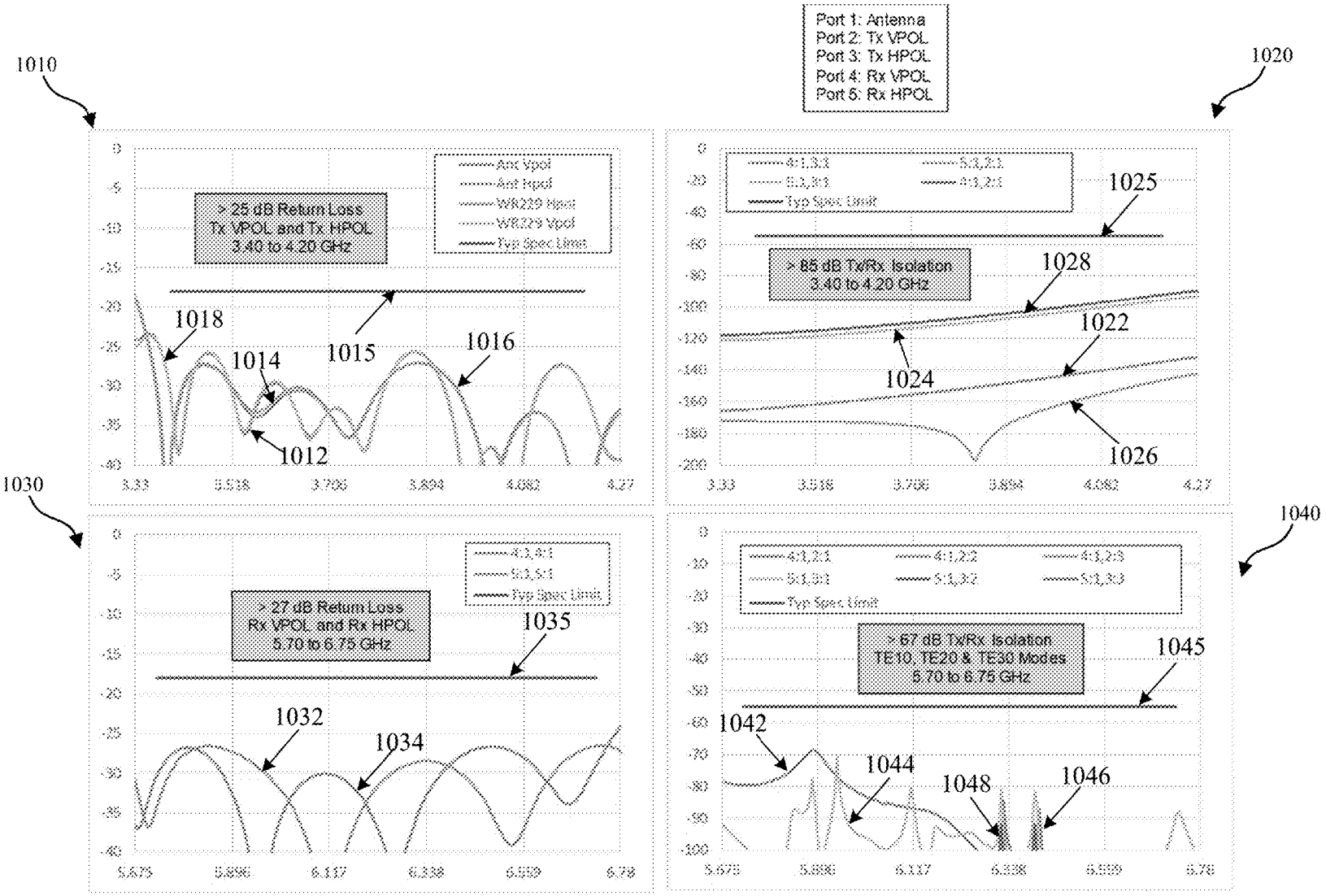
FIG. 10 illustrates charts showing plots of simulated data of an exemplary linear multiband waveguide feed, according to certain aspects of the disclosure.

FIG. 10 illustrates charts 1010, 1020, 1030, and 1040 showing plots of simulated data of an exemplary linear multiband waveguide feed, according to certain aspects of the disclosure. The chart 1010 includes a plot 1015 depicting a typical specification limit at about −18 dB and plots 1012, 1014, 1016 and 1018 depicting return loss for an antenna V-Pol, an antenna H-Pol, a waveguide (e.g., WR229) H-Pol and a waveguide V-Pol, respectively. The return loss for the Tx V-Pol and Tx H-Pol are greater than 25 dB for the frequency range of 3.4 GHz to 4.2 GHz.

The chart 1020 includes a plot 1025 depicting a typical specification limit at about −55 dB and plots 1022, 1024, 1026 and 1028 depicting Rx to Tx isolation for Rx V-Pol to Tx H-Pol, Rx H-pol to Tx H-Pol, Rx H-Pol to Tx V-Pol and Rx V-Pol to Tx V-Pol, respectively. The isolation for the Tx-Rx are greater than 85 dB for the frequency range of 3.4 GHz to 4.2 GHz.

The chart 1030 includes a plot 1035 depicting a typical specification limit at about −18 dB and plots 1032 and 1034 depicting return loss for an antenna V-Pol and an antenna H-Pol, respectively. The return loss for the Rx V-Pol and Rx H-Pol are greater than 27 dB for the frequency range of 5.7 GHz to 6.75 GHz.

The chart 1040 includes a plot 1045 depicting a typical specification limit at about −55 dB and plots 1042, 1044, 1046 and 1048 depicting Rx to Tx isolation for Rx V-Pol to Tx H-Pol, Rx H-pol to Tx H-Pol, Rx H-Pol to Tx V-Pol and Rx V-Pol to Tx V-Pol, respectively. The isolation for the TE10, TE20 and TE30 modes are greater than 67 dB for the frequency range of 5.7 GHz to 6.75 GHz.

In summary, the linear multiband waveguide feed of the subject technology provides a compact and lightweight solution to applications requiring the capability of both linear and circular polarization. The disclosed linear multiband waveguide feed is a high-performance, low-mass and low-cost waveguide-feed solution for extended multibands, including C-band. For example, the advantageous positioning of components results in a significant mass reduction. The loaded magic tees absorb path-length mismatch and mitigate manufacturing risk.

Those of skill in the art would appreciate that the various illustrative blocks, modules, elements, components, methods and algorithms described herein may be implemented as electronic hardware, computer software or combinations of both. To illustrate this interchangeability of hardware and software, various illustrative blocks, modules, elements, components, methods and algorithms have been described above generally in terms of their functionality. Whether such functionality is implemented as hardware or software depends upon the particular application and design constraints imposed on the overall system. Skilled artisans may implement the described functionality in varying ways for each particular application. Various components and blocks may be arranged differently (e.g., arranged in a different order or partitioned in a different way), all without departing from the scope of the subject technology.

It is understood that any specific order or hierarchy of blocks in the processes disclosed is an illustration of example approaches. Based upon design preferences, it is understood that the specific order or hierarchy of blocks in the processes may be rearranged, or that all illustrated blocks may be performed. Any of the blocks may be performed simultaneously. In one or more implementations, multitasking and parallel processing may be advantageous. Moreover, the separation of various system components in the embodiments described above should not be understood as requiring such separation in all embodiments, and it should be understood that the described program components and systems can generally be integrated together in a single hardware and software product or packaged into multiple hardware and software products.

The description of the subject technology is provided to enable any person skilled in the art to practice the various aspects described herein. While the subject technology has been particularly described with reference to the various figures and aspects, it should be understood that these are for illustration purposes only and should not be taken as limiting the scope of the subject technology.

A reference to an element in the singular is not intended to mean "one and only one" unless specifically stated, but rather "one or more." The term "some" refers to one or more. All structural and functional equivalents to the elements of the various aspects described throughout this disclosure that are known or later come to be known to those of ordinary skill in the art are expressly incorporated herein by reference and intended to be encompassed by the subject technology. Moreover, nothing disclosed herein is intended to be dedicated to the public, regardless of whether such disclosure is explicitly recited in the above description.

Although the invention has been described with reference to the disclosed aspects, one having ordinary skill in the art will readily appreciate that these aspects are only illustrative of the invention. It should be understood that various modifications can be made without departing from the spirit of the invention. The particular aspects disclosed above are illustrative only, as the present invention may be modified and practiced in different but equivalent manners apparent to those skilled in the art having the benefit of the teachings herein. Furthermore, no limitations are intended to the details of construction or design herein shown, other than as described in the claims below. It is therefore evident that the particular illustrative aspects disclosed above may be altered, combined or modified, and all such variations are considered within the scope and spirit of the present invention. While compositions and methods are described in terms of "comprising," "containing" or "including" various components or steps, the compositions and methods can also "consist essentially of," or "consist of," the various components and operations. All numbers and ranges disclosed above can vary by some amount. Whenever a numerical range with a lower limit and an upper limit is disclosed, any number and any subrange falling within the broader range are specifically disclosed. Also, the terms in the claims have their plain, ordinary meanings unless otherwise explicitly and clearly defined by the patentee. If there is any conflict in the usage of a word or term in this specification and one or more patent or other documents that may be incorporated herein by reference, the definition that is consistent with this specification should be adopted.

What is claimed is:

1. A linear multiband waveguide feed network device, the device comprising:

a first section;

a second section coupled to the first section via a first split-plane;

a third section coupled to the second section via a second split-plane; and an inverse-ridge receive (Rx)-reject filter implemented as a first half-portion and a second half-portion;

wherein:

the first split-plane and the second split-plane are on a zero-current region of the device, the first half-portion and the second half-portion are implemented in the second section and the third section, respectively, the inverse-ridge Rx-reject filter comprises four branches coupled to an antenna port implemented in the third section, and wherein the four branches include a first and a second branch coupling the antenna port to Tx V-Pol port via a pair transmit (Tx) vertical polarization (V-Pol) rectangular-waveguide (RWG) H-plane bends (Hbends) and Tx waveguide routings.

2. The device of claim 1, wherein the four branches include a third and a fourth branch coupling the antenna port to a loaded waveguide port and a Tx H-Pol port via a pair of recombination arms and a Tx horizontal polarization (H-Pol) magic tee.

3. The device of claim 1, wherein the inverse-ridge Rx-reject filter is configured to achieve a broadband Tx-Rx isolation associated with higher-order modes including a transverse-electric (TE) 20 mode.

4. The device of claim 3, wherein the broadband Tx-Rx isolation associated with the higher-order modes is greater than about 85 dB for a first frequency band of 3.4 GHz to 4.2 GHz and greater than about 67 dB for a second frequency band of 5.7 GHz to 6.75 GHz.

5. The device of claim 3, wherein a return loss associated with Tx V-Pol and Tx H-Pol ports is greater than about 25 dB for a first frequency band of 3.4 GHz to 4.2 GHz and greater than about 27 dB for a second frequency band of 5.7 GHz to 6.75 GHz.

6. The device of claim 1, wherein an Rx V-Pol port, a Tx H-Pol port and a Tx V-Pol port are accessible from the first section, and wherein an Rx H-Pol port and two loaded ports are implemented in the first section and the second section.

7. The device of claim 6, wherein the antenna port is coupled to the Rx V-Pol port and the Rx H-Pol port via a Tx reject filter and an Rx orthomode transducer (OMT), wherein the antenna port is coupled to the Tx reject filter via a main manifold, a step connector and a matching ring.

8. The device of claim 7, wherein the Tx reject filter, the matching ring and the step connector are implemented in the second section, and the Rx OMT and the main manifold are partially implemented in the second section.

9. The device of claim 1, wherein the first section, the second section and the third section are brazed or connected together via hardware connectors.

10. A waveguide feed apparatus, the apparatus comprising:

a receive (Rx) portion including an Rx orthomode transducer (OMT), a Tx reject filter and a main manifold; and a first Tx portion including a front transmit (Tx) portion and a second Tx portion, the first Tx portion including a plurality of inverse-ridge Rx-reject filters and a Tx magic tee, and the second Tx portion including a Tx vertical polarization (V-Pol) magic tee and a pair of Tx V-Pol waveguide H-bends that is coupled to a Tx V-Pol port, wherein:

the Tx V-Pol port is implemented in a first section of the apparatus, the Tx reject filter is implemented in a second section of the apparatus, the inverse-ridge Rx-reject filters and Tx magic tee are common between the second section and a third section of the apparatus, and a first split-plane between the first section and the second section and a second split plane between the second section and the third section are on a zero-current region of the apparatus.

11. The apparatus of claim 10, wherein each inverse-ridge Rx-reject filter comprises four branches coupled to an antenna port implemented in the third section.

12. The apparatus of claim 11, wherein the four branches include a first and a second branch coupling the antenna port to the Tx V-Pol port via the pair of Tx V-Pol waveguide H-bends and Tx waveguide routings.

13. The apparatus of claim 11, wherein the four branches include a third and a fourth branch coupling the antenna port to a loaded waveguide port and a Tx H-Pol port via a pair of recombination arms and a Tx H-Pol magic tee.

14. The apparatus of claim 11, wherein the inverse-ridge Rx-reject filter is configured to achieve a broadband Tx-Rx isolation associated with higher-order modes including a TE 20 mode.

15. The apparatus of claim 14, wherein the broadband Tx-Rx isolation associated with the higher-order modes is greater than about 85 dB for a first frequency band of 3.4 GHz to 4.2 GHz and greater than about 67 dB for a second frequency band of 5.7 GHz to 6.75 GHz.

16. The apparatus of claim 11, wherein a return loss associated with Tx V-Pol and Tx H-Pol ports is greater than about 25 dB for a first frequency band of 3.4 GHz to 4.2 GHz and greater than about 27 dB for a second frequency band of 5.7 GHz to 6.75 GHz.

17. A satellite communication system comprising:

a satellite antenna; and a feed network device comprising:

a first section;

a second section coupled to the first section via a first split-plane;

a third section coupled to the second section via a second split-plane; and an inverse-ridge receive (Rx)-reject filter implemented as a first half-portion and a second half-portion, wherein:

the first split-plane and the second split-plane are on a zero-current region of the feed network device, the feed network device comprises a linear multiband waveguide, the inverse-ridge Rx-reject filter comprises four branches coupled to an antenna port implemented in the third section, and the four branches include a first and a second branch coupling the antenna port to a transmit (Tx) vertical polarization (V-Pol) port via a pair of Tx V-Pol rectangular-waveguide (RWG) H-plane bends (Hbends) and Tx waveguide routings.

18. The satellite communication system of claim 17, wherein:

a third and a fourth branch coupling the antenna port to a loaded waveguide port and a Tx horizontal polarization (H-Pol) port via a pair of recombination arms and a Tx H-Pol magic tee, and the inverse-ridge Rx-reject filter is configured to achieve a broadband Tx-Rx isolation of higher-order modes including a transverse-electric (TE) 20 mode.

* * * * *